US009299239B1

(12) United States Patent
Gieck

(10) Patent No.: US 9,299,239 B1
(45) Date of Patent: Mar. 29, 2016

(54) DEVICE AND METHODS FOR MONITORING ENVIRONMENTAL CONDITIONS

(71) Applicant: Travis John Gieck, Calgary (CA)

(72) Inventor: Travis John Gieck, Calgary (CA)

( * ) Notice: Subject to any disclaimer, the term of this patent is extended or adjusted under 35 U.S.C. 154(b) by 0 days.

(21) Appl. No.: 14/489,375

(22) Filed: Sep. 17, 2014

(51) Int. Cl.

| | |
|---|---|
| ***G08B 17/00*** | (2006.01) |
| ***G08B 21/18*** | (2006.01) |
| ***F25D 29/00*** | (2006.01) |
| ***G08B 17/10*** | (2006.01) |

(52) U.S. Cl.
CPC ..... *G08B 21/182* (2013.01); *F25D 29/008* (2013.01); *G08B 17/10* (2013.01)

(58) Field of Classification Search
CPC ..... A61B 2560/0271; A61B 5/0002; A61B 5/0022; A61B 5/02; A61B 5/04; A61B 5/08; A61B 5/145; A61B 5/14539; A61B 5/411; A61B 5/4839; A61B 5/486; A61M 2005/1726; A61M 2205/3523; A61M 2205/3569
USPC ..... 340/585, 870.01, 870.16, 500, 657, 340/521, 601, 693.3, 5.52, 539.26, 568.2, 340/691.6
See application file for complete search history.

(56) References Cited

U.S. PATENT DOCUMENTS

| | | | | |
|---|---|---|---|---|
| 5,259,553 | A | 11/1993 | Shyu | |
| 6,587,807 | B2 | 7/2003 | Awtrey | |
| 6,798,341 | B1 | 9/2004 | Eckel | |
| 6,919,803 | B2 | 7/2005 | Breed | |
| 7,142,123 | B1 * | 11/2006 | Kates | G01N 27/048 340/602 |
| 7,148,796 | B2 * | 12/2006 | Joy | G01K 13/00 340/52.52 |
| 7,292,963 | B2 | 11/2007 | Bornhoevd | |
| 7,474,210 | B2 * | 1/2009 | Roberts | G07C 3/00 235/385 |
| 7,742,744 | B2 | 6/2010 | Twitchell | |
| 8,086,407 | B2 | 12/2011 | Chan | |
| 8,214,085 | B2 * | 7/2012 | Boudreau | F24F 11/0015 236/44 C |
| 8,239,169 | B2 | 8/2012 | Gregory | |
| 2007/0220907 | A1 * | 9/2007 | Ehlers | F25B 49/005 62/126 |
| 2008/0197999 | A1 * | 8/2008 | Henderson | G08B 17/125 340/521 |
| 2010/0063832 | A1 * | 3/2010 | Brown | G06Q 30/02 705/1.1 |
| 2010/0259377 | A1 * | 10/2010 | Cho | H04L 12/2825 340/531 |
| 2013/0151172 | A1 * | 6/2013 | Rao | G01N 27/048 702/50 |
| 2015/0091723 | A1 * | 4/2015 | Fiedler | G08B 19/00 340/521 |

FOREIGN PATENT DOCUMENTS

| | | | |
|---|---|---|---|
| WO | 2011/002585 | A1 | 1/2011 |
| WO | 2012/125140 | A1 | 9/2012 |

* cited by examiner

*Primary Examiner* — Daniel Previl
(74) *Attorney, Agent, or Firm* — McQIPLaw; Jeffrey McQuiston

(57) ABSTRACT

Disclosed herein is a monitoring device comprising a sensor or probe for measuring an environmental condition inside a building, a display unit for displaying the level of the environmental condition, and a communication device that transmits text messages if the level of the environmental condition passes a predetermined threshold level.

13 Claims, 7 Drawing Sheets

DEVICE AND METHODS FOR MONITORING ENVIRONMENTAL CONDITIONS

FIELD OF THE INVENTION

The present invention is in the field of monitoring devices. More specifically, the present invention is in the field of devices that plug into the wall, monitor environmental conditions, such as room temperature and presence of water, and communicate with a third party when the environmental conditions pass a predetermined threshold level.

BACKGROUND OF THE DISCLOSURE

When a home or business owner leaves the property for a significant period of time, for example when the owner is on a holiday or during long weekends, there is a chance that certain environmental mishaps can damage the property. For example, a burst pipe can cause flooding, or a failed furnace in winter months can cause the temperatures inside the property to fall below freezing and damage the interior. Similarly, a malfunctioning air conditioning unit can result in very high temperatures inside the property, damaging plants, equipment, or pets that are left in the property.

Currently, there are some alarm systems on the market that can monitor environmental conditions. However, these alarm systems involve a significantly high monthly fee and high installation costs. Therefore, a need exists for a cost effective monitoring device that can communicate with the absent property owner about changes in the environmental conditions inside their property.

SUMMARY OF THE INVENTION

Disclosed herein are monitoring devices comprising a sensor or probe for measuring an environmental condition inside a building, a display unit for displaying the level of the environmental condition, and a communication device that transmits information if the level of the environmental condition passes a predetermined threshold level.

DETAILED DESCRIPTION OF THE EMBODIMENTS

Figure 1:
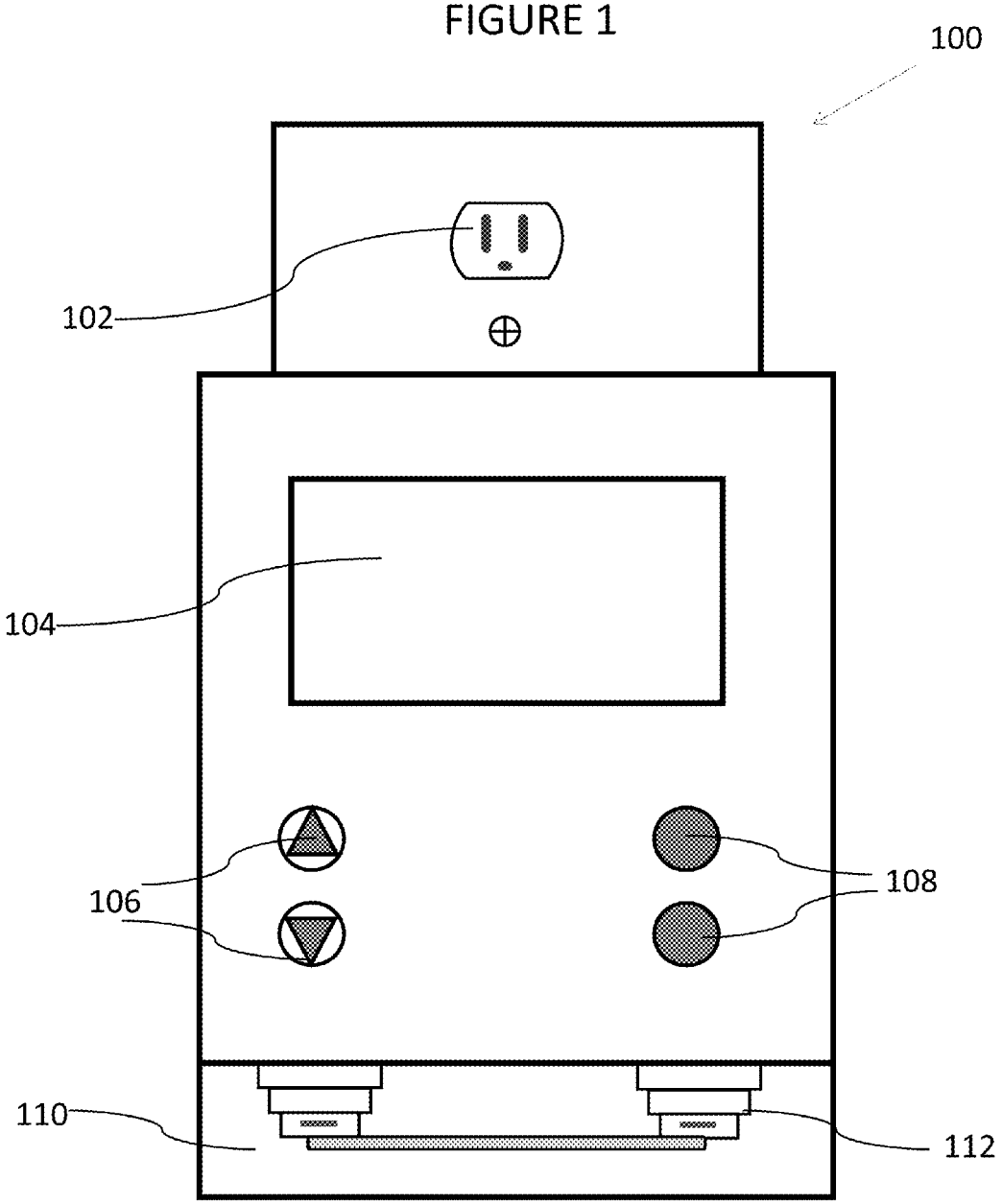
FIG. 1 is the front view of an embodiment of the monitoring device disclosed herein.

The terminology used herein is for the purpose of describing particular embodiments only and is not intended to be limiting of the invention. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising."

Disclosed herein are monitoring devices that monitor one or more environmental condition within an enclosure, for example, a home, a business, a car garage, a shed, a storage unit, and the like. When the environmental condition goes over, or falls below, a preset threshold level, the device sends an electronic notification, such as an e-mail, a text, a prerecorded phone message, to a contact person, relaying the change in the environmental condition.

Thus, in one aspect, disclosed herein are monitoring devices comprising a sensor or probe for measuring an environmental condition inside an enclosure, and a communication device that transmits information when the level of the environmental condition passes a predetermined threshold level.

In the context of the present disclosure, an "environmental condition" refers to a physical or chemical attribute of the environment. The physical attributes include, but are not limited to, temperature, color, phase of matter, and the like. The chemical attributes include the presence, absence, or the amount (e.g., concentration) of a chemical within the environment. Thus, as examples of physical attributes, the present device can detect the air temperature, which can alert to the presence of fire, or the failure of a heater or air conditioner. The device can detect the color of the air, which can alert to the presence of smoke or other noxious gases. The device can detect the presence of a liquid, where only gaseous substances are expected, thereby alert to the presence of flooding. As examples of chemical attributes, the present device can detect the presence of carbon dioxide, carbon monoxide, dioxane, hydrogen sulfide, hydrocarbons, water, and the like.

"Sensor" means any device or entity capable of sensing an environmental condition including, but not limited to, temperature, moisture in the air, airborne chemicals, and water on the floor. Sensors include, but are not limited to, a pressure sensor, a flow sensor, a temperature sensor, a humidity sensor, a light sensor, a gas sensor, an acceleration sensor, a chemical sensor (for example a hydrocarbon sensor, a carbon dioxide sensor, a dioxane sensor, a hydrogen sulfide sensor, a urea sensor, and the like), an electrical field distribution sensor, and an electrical field penetration sensor.

In some embodiments, the disclosed devices comprise a display unit for displaying the level of the environmental condition.

In one embodiment, the sensor is configured to measure or sense an environmental condition, such as the air temperature or the presence of a substance in the air, for example water for measuring humidity, or the presence of a chemical. In another embodiment, the sensor is configured to determine the presence of water on the floor. Consequently, depending on what is being measured, in some embodiments multiple devices, each having one sensor, are used. Alternatively, a single device comprises multiple sensors to measure different environmental conditions.

In one embodiment, the devices disclosed herein further comprise a control unit for programming the threshold level of the environmental condition. In another embodiment, the devices further comprise one or more extendable probes that are placed close to the floor, or on the floor, for detecting the presence of water. In another embodiment, multiple sensing probes are connected to the device, wherein one such probe is placed inside a refrigerator or freezer to monitor the temperature inside the refrigerator or freezer. The temperature probes inside the refrigerator or freezer monitors if temperature has risen above a set point or dropped below a set point. This provides the owner an early warning prior to food spoiling if the refrigerator or freezer fails.

In some embodiment, the devices disclosed herein comprise a communication unit. The communication unit operates similarly to a mobile phone. In some embodiments, the communication unit is a phone (operating similarly to a mobile phone) that is connected to the monitoring device. In some embodiments, the presently disclosed device comprises a phone jack for connection to a conventional phone land line. The device is then connected to a wall phone jack using a telephone cord, by way of which, the device is connected to the conventional land line phone system.

When the environmental condition falls below, or goes over, a preset threshold limit, the monitoring device triggers the communication unit for a message to be sent. The message can be in the form of a text message, an e-mail, a Twitter post, a pre-recorded phone message, and the like. The user inputs the contact information for the intended recipient of the message into the communication unit. In some embodiments, the intended recipient is the property owner. In other embodiments, the intended recipient is an agent of the property owner who is tasked with overseeing the property in the owner's absence. In still other embodiments, the intended recipient is the emergency services, for example the police, the fire department, a 9-1-1 operator, or the insurance company. In one embodiment, the device uses wireless technology and a computer present in the building to send an email notification to predetermined email addresses. In one embodiment, the device uses wireless technology to send a text message notification to predetermined cell phones. In some embodiments, multiple intended recipients receive the notification.

In certain embodiments, the device sends the notification for one event to one set of recipients, and sends the notification for another event to another set of recipients. For example, in case of measuring smoke and high temperatures in the property, the device notifies the fire department and the owner. But in case of the presence of water on the floor, the device notifies a plumber and the owner. In some embodiments, the notification is by way of an automatic text or phone call with alarm alerts.

In one embodiment, the device sends a notification if the temperature rises above a threshold level, or if the temperature falls below a threshold level. This is useful because it provides the homeowner with an early warning of certain hazards. For example, in one embodiment, during the winter months, in case of furnace or heater failure, the device can alert the homeowner or other responsible individual, for example a caretaker or neighbor, of the failure, which can elicit a timely response. This protects pets, children, the elderly, or the infirm, who are left alone, or the furniture or other materials in the house or building against exposure to dangerously low temperatures.

Similarly, in another embodiment, during the summer months or when air conditioning is necessary, in case of air conditioner failure, the device can alert the homeowner or other responsible individual of the failure, which can elicit a timely response. This protects pets, children, the elderly, or the infirm, who are left alone, or the furniture or other materials in the house or building against exposure to dangerously high temperatures.

Likewise, in another embodiment, if the temperature gets too high in case of fire, the device can alert the homeowner, the emergency service, the local Fire Department, or the insurance company.

Consequently, this device further minimizes the risk for insurance companies by providing an early alert, and thereby minimizing the amount of damage that can incur.

In some embodiments, the sensor probes are embedded within the monitoring device. In other embodiments, the sensor probes are external to the device, but are connected directly to the device by wire. In still other embodiments, the sensor probes are external to the device, and send a wireless signal. The device receives the wireless signal and interprets the signal for the information it contains, which can be the results of the measurement. In certain embodiments, the device sends a wireless signal to the probes to ensure that the probe is still in communication with the device. In other embodiments, the wireless signal from the probe also includes a status update for the probe, for example battery life or any electrical damage.

The technology for sending and receiving wireless information between the probe and the device is routine and is generally available to those of ordinary skill in the art.

In one embodiment disclosed herein, the device samples the temperature at specified time intervals, for example, every second, every minute, or every hour.

In one embodiment, the device further comprises an LCD display for displaying the value of the measurement by the probe. In some embodiments, the device further comprises a power outlet in the front of the device so that other utilities can be plugged into the same power outlet at the same time. In one embodiment, the device further comprises battery backup in case of power outage. In one embodiment, the device further comprises sending a notification to the intended recipient when backup battery life is low.

In one embodiment, the device connects to a wireless programmable thermostat, allowing the user to monitor and adjust the thermostat remotely using a mobile application.

Referring now to FIG. 1, system 100 is one embodiment of the device disclosed herein. In some embodiments, the system 100 connects to an electric outlet 102. In other embodiments, the system 100 is battery operated and does not connect to an electric outlet. In still other embodiments, the system 100 connects to an electric outlet but has a backup battery system. In some embodiments, for example that shown in FIG. 1, an LCD screen, 104, displays the measured environmental condition, for example temperature or humidity and the like. In certain embodiments, buttons 106 are used to adjust the threshold of the measured environmental condition. One button is used to raise the threshold while another button is used to lower the threshold.

In some embodiments, the buttons 106 are used to navigate through menus that allow the user to program the system 100 for thresholds and for who to contact. For examples, the buttons 106 are used to enter a phone number that should be called, enter a text message that should be sent, operate the recording device for the pre-recorded phone message to be sent, and the like. In some embodiments, instead of the buttons 106, the system 100 comprises a touch screen system that allows the user to navigate through menus, much like the menus on a smart phone, to access the above parameters.

In some embodiments, the system 100 is configured to measure more than one environmental condition. In these embodiments, buttons 108 are used to toggle between the different environmental conditions to set the threshold values therefor. In some embodiments, probes 110 and 112 are built into the system 100 for the measurement of one or more environmental condition. In some embodiments, the same probe 110 measures more than one environmental condition, whereas in other embodiments, a single probe 110 measures a single environmental condition. In one embodiment, the probes 110,112 are hidden from view, whereas in other embodiments, the probes 110,112 are visible. When the probes 110,112 are hidden from the view, in some embodiments a removable cover is used to hide the probes 110,112.

In some embodiments, for example those in which water level is measured on the floor in case of flooding, the probes 110,112 are telescopic. When the device is not in use, the probes 110,112 are in their retracted position. In some embodiments, when the probes 110,112 are in the retracted position they are hidden from view under a cover. When the user desires to set the system 100, for example prior to leaving on vacation, the user extends the probes 110,112 until they reach to the floor or near to the floor. In their extended position, when water touches both probes 110 and 112, the water itself closes an electrical circuit between the probes 110 and 112 and causes the device to register an adverse event has occurred.

Figure 2:
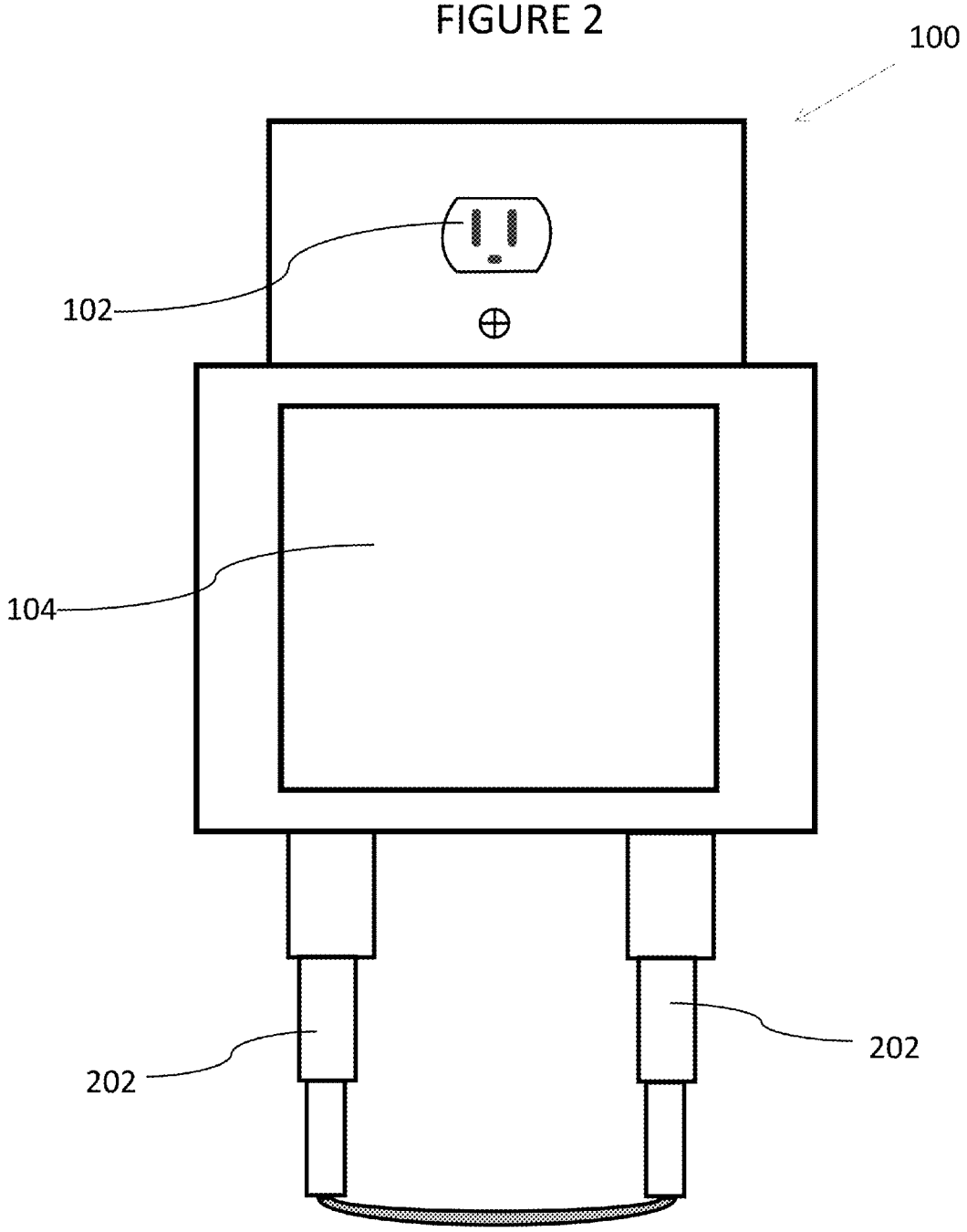
FIG. 2 is the front view of an embodiment of the monitoring device disclosed herein.

FIG. 2 shows one embodiment of the device 100 where the sensor probes 202 are extended downwards. In some of these embodiments, the probes extend downwards to whatever height above the floor the homeowner desires. The sensor can then sense the environmental condition at a height shortly above the floor. For example, during flooding, the water level is at the ground level. In this case, the water comes into contact with the probes 202, thereby completing the circuit (for example that shown in FIG. 7), and giving rise to a signal.

In some embodiments, the device comprises a smoke detector feature, or the device is in electronic communication with a smoke detector. When the smoke detector detects smoke, the device is electronically alerted, which can then send an alert as discussed herein.

Figure 3:
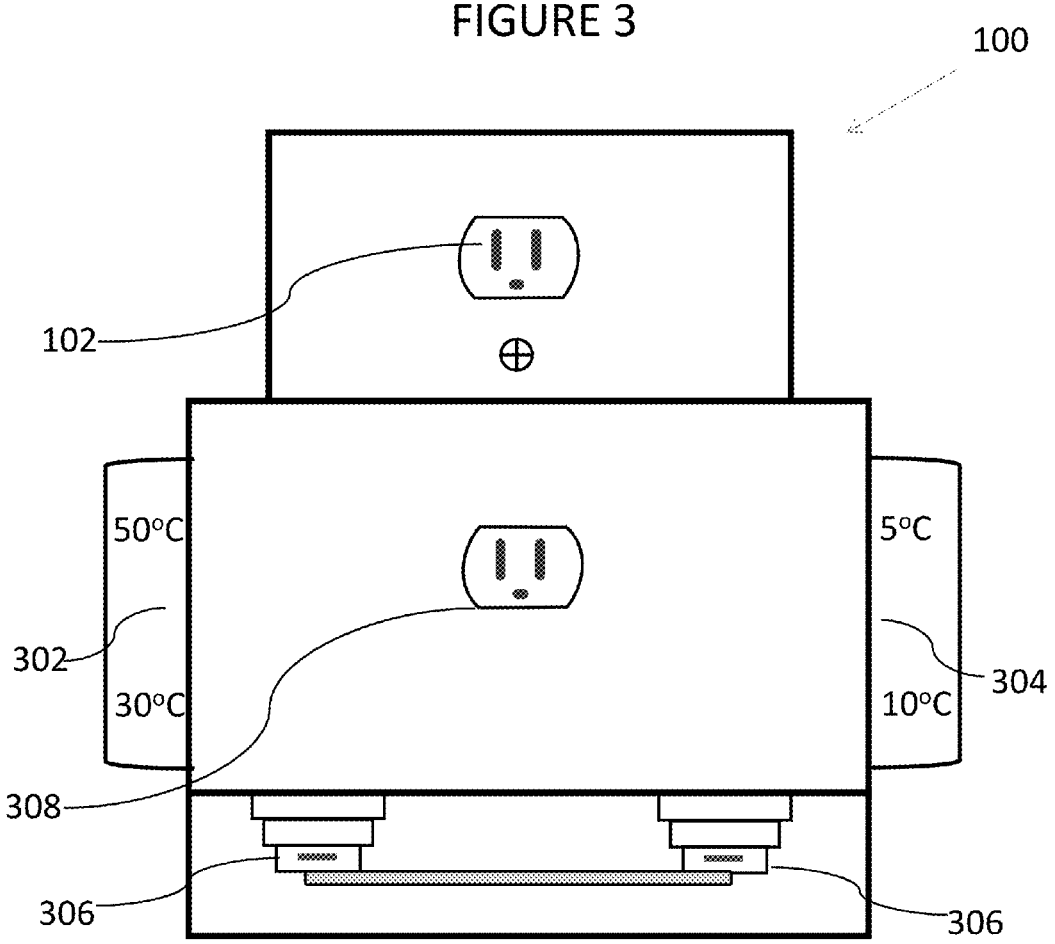
FIG. 3 is the front view of an embodiment of the monitoring device disclosed herein.
Figure 4:
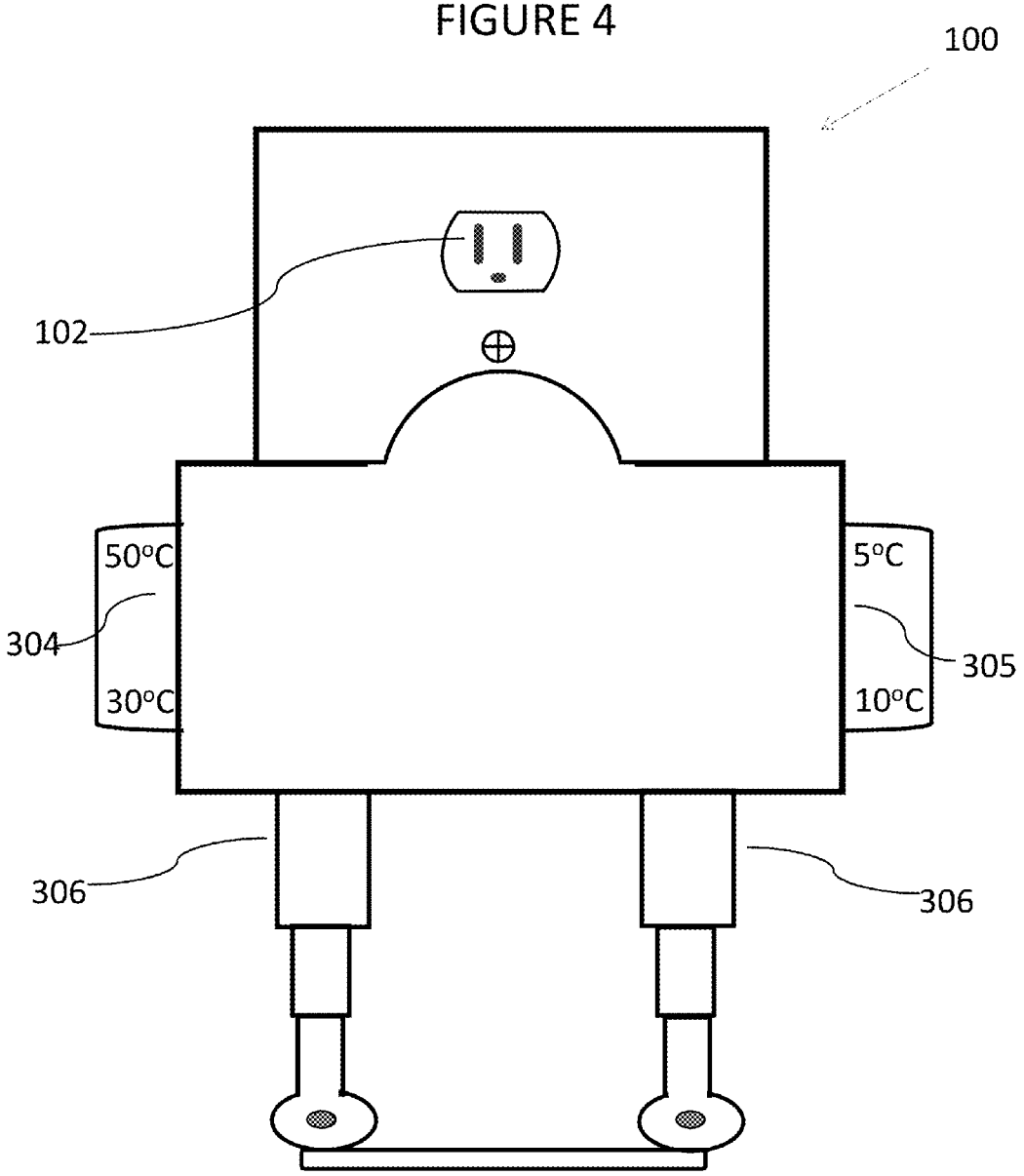
FIG. 4 is the front view of an embodiment of the monitoring device disclosed herein.

FIG. 3 shows one embodiment of the device 100 with two dials 302,304 on each side of the device 100 for choosing a high threshold for the environmental condition and a low threshold for the environmental condition, respectively. In some embodiments, the probes 306 are hidden from view, while in other embodiments, for example that shown in FIG. 4, the probes extend down. In these embodiments, the user sets a high threshold and a low threshold, and the device activates an alert when either of these thresholds is surpassed. In one embodiment, an electric power outlet 308 is present on the front of the device, so that another device can occupy the power outlet at the same time.

In one embodiment, the device looks similar to a carbon monoxide detector with a LCD display, with buttons that allow a user to program the device, and metal probes at its base that extend downwards.

Figure 5:
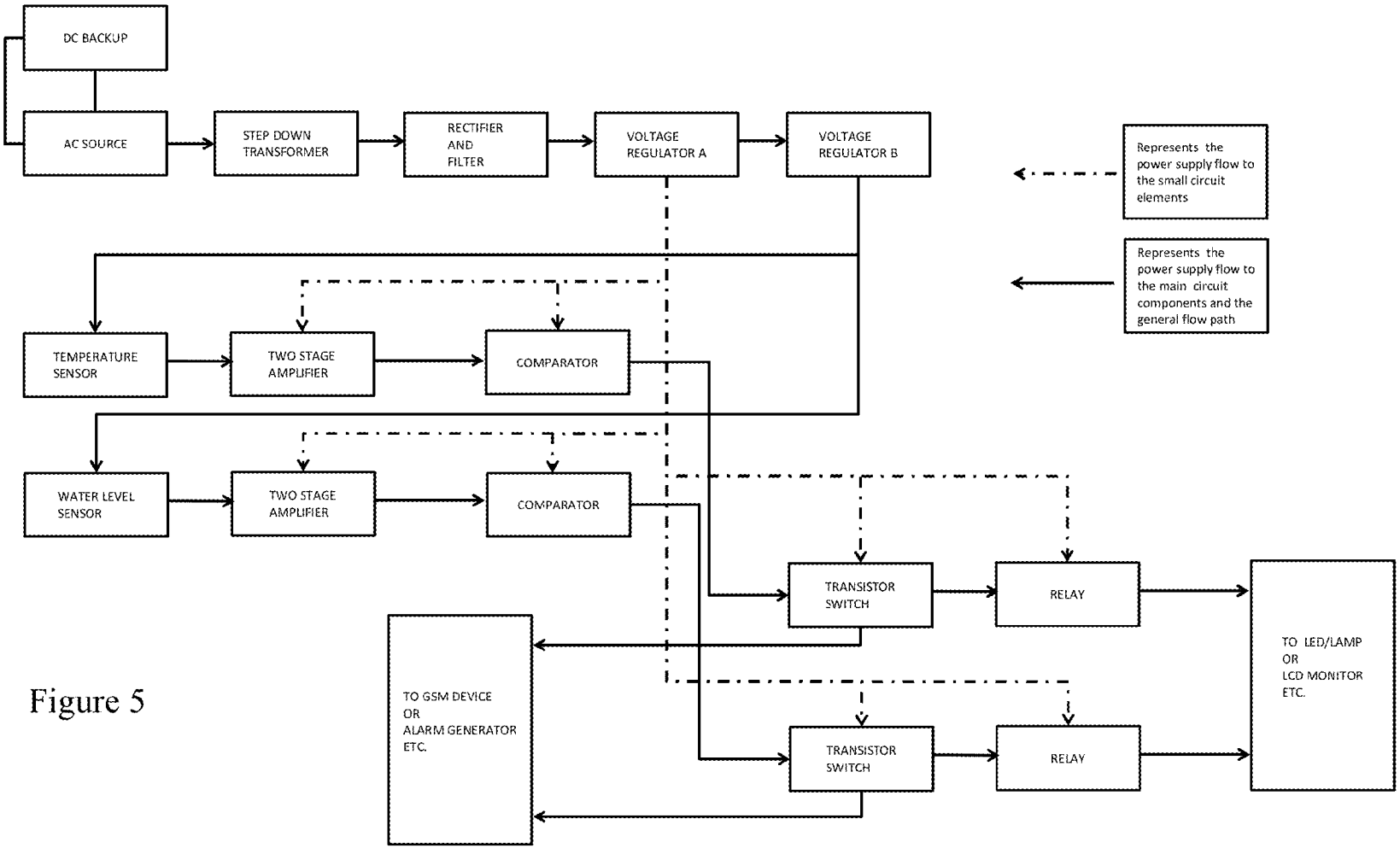
FIG. 5 is a flowchart of an embodiment of the monitoring device disclosed herein.

FIG. 5 is a flow chart illustrating one embodiment of the mechanism by which a device 100 disclosed herein senses an environmental condition and sends a signal to a recipient.

The flow chart provides a description of an embodiment of temperature and high water level detection. There are 3 main layers. The top layer is the Power Supply layer. The Middle Layer comprises two sub layers, referred to as the Temperature Sensing layer and the Water Sensing Layer. The bottom layer is the Signal Output layer, which is also broken down into two sub layers for output from each of the Middle layers.

Top Layer has a main supply as the AC (alternating current) source with a DC (direct current) backup. The power then feeds to a step down transformer and filter combination. "Voltage Regulator A" provides power to the small circuit elements of the entire system, which include all amplifiers, comparators, transistors and relays. "Voltage Regulator B" provides power to the Temperature and Water Level sensors in the system.

The middle layer is used to detect either temperature or water level. With the sensors activated the signal is then amplified and a comparator is used to compare a base signal to an activated signal. Once it detects a change in signal output from the sensors the signal then flows to the bottom layer.

The bottom layer utilizes a transistor switch to control a relay for a lamp, LED or LCD monitor output. In addition it can also send a signal to a GSM (Global System for Mobile communications) device or an audible alarm generator.

Figure 6:
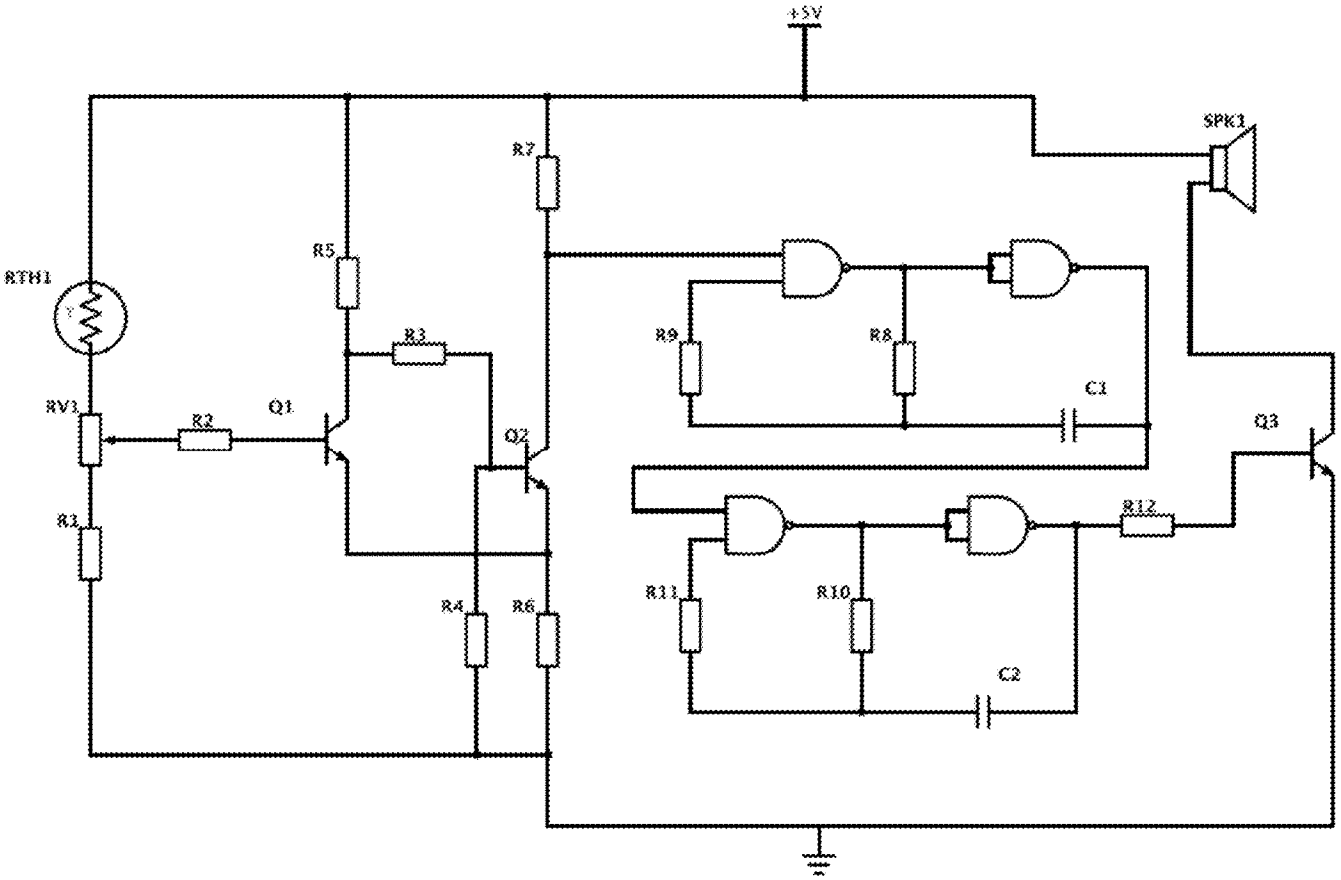
FIG. 6 is a circuit diagram of an embodiment of the temperature monitoring device.

FIG. 6 is a detailed circuit diagram, which shows one embodiment of a circuit used with a device 100.

The thermistor RTH1 is the element that senses the temperature of the environment as the resistance of the device changes with temperature. The circuit uses two NPN transistors that switch the alarm when a change in resistance (or temperature) is detected. The signal then goes to a combinational oscillator circuit comprised of NAND gates. The inherent time delay between the input and output is then used, hence making the NAND gate circuit work as an oscillator. The circuit then turns on and off repeatedly with a time delay operating as a square wave oscillator. The output of the oscillator can be sent to a speaker which operates at the audio frequency. The capacitors used in the circuit acts as filters to remove unwanted components of the signals and hence ensuring stability and proper operation. The output can also be sent from the NPN stage directly to a GSM device bypassing the oscillator circuit.

Figure 7:
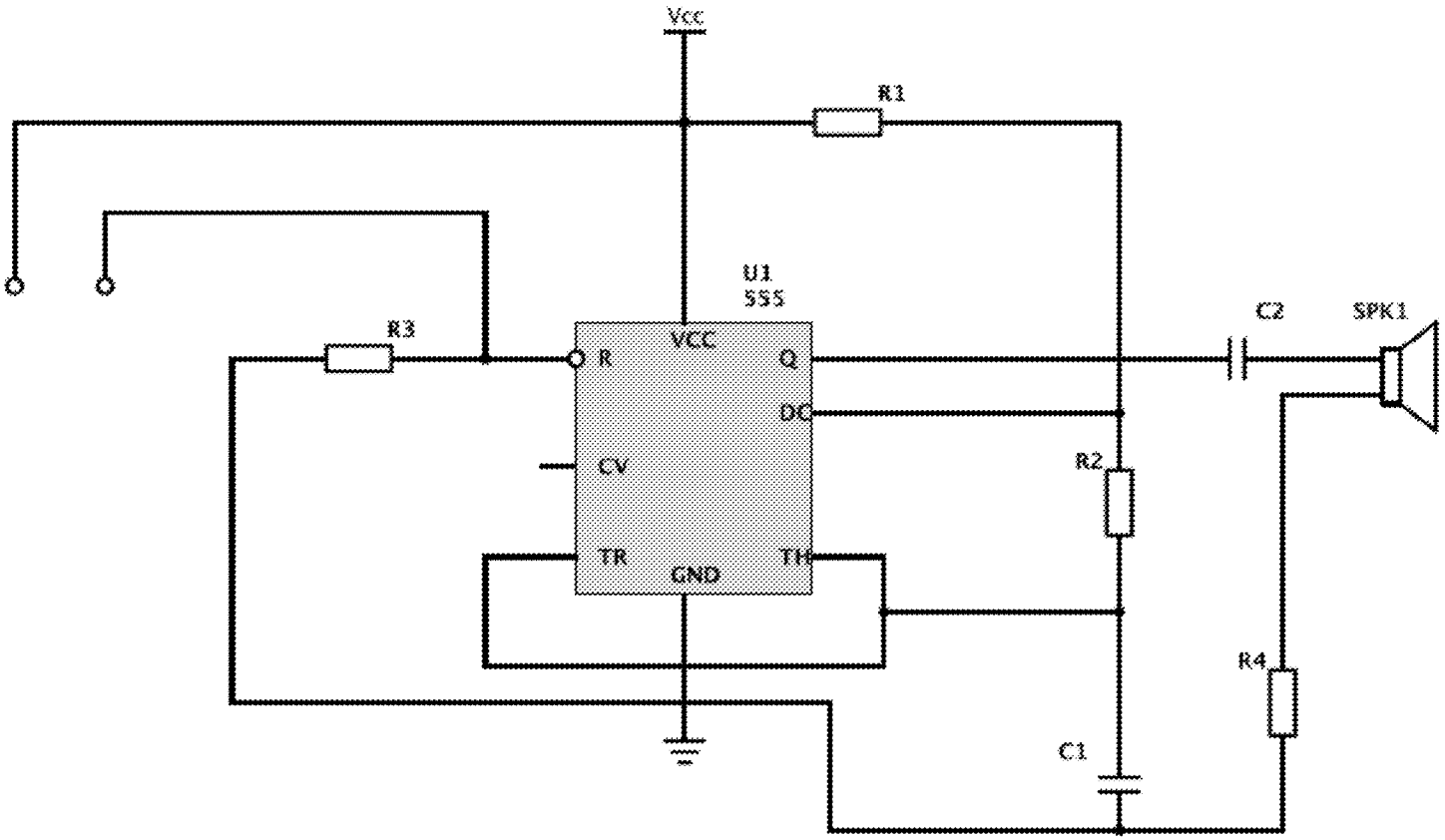
FIG. 7 is a circuit diagram of an embodiment of the water monitoring device.

FIG. 7 is a detailed circuit diagram, which shows one embodiment of a circuit used with a device 100.

Using an IC (integrated circuit) Timer circuit the water level is detected and an alarm signal is sent to an output device of choice, as discussed above. The circuit uses the Timer in astable mode with R1, R2 and C1. The frequency of operation of the IC Timer in astable mode depends of the values of R1, R2 and C1. The values can be adjusted to achieve any desired frequency. This frequency will be the audio frequency of the alarm output.

The ends of R3 are connected to the pin-R of the IC Timer and the ground disables the circuit by default. When the probe ends get dipped in water as the water level rises, for example in a flood situation, the circuit is enabled. The probes shown in the circuit are kept at a high level for the water (as high as is allowable). In some embodiments, the astable multivibrator in the circuit is disabled and is enabled only when the probes touch the water. In some embodiments, the distance between the probes is less than a few centimeters to ensure that the conduction between the probes takes place when the probes touch water. When the water reaches the height of the probes the IC Timer circuit becomes enabled and the Timer produces a square wave circuit at the frequency as determined by R1, R2 and C1. This output can then be sent to a speaker or GSM device etc.

In one embodiment, the device sends an alarm notification, and gives an output such as an audible alarm, communication with a mobile device, or a phone call to a service company. In one embodiment, the device 100 sends another notification when the problem with the environmental condition is restored.

In some embodiments, the device comprises a microphone and a recorder that allows the user to record a message that is sent to a service company as a pre-recorded message as part of the communication with the service company. In other embodiments, the device comprises a series of pre-recorded, factory installed, messages. The user can choose the particular message the user would like to be sent to the service company.

While the present disclosure has been described and illustrated herein, it is intended that the specification and examples be considered as exemplary only, with the true scope and spirit of the invention being indicated by the following claims.

What is claimed is:

1. A monitoring device comprising:

one or more probes for measuring an environmental condition inside a building, wherein at least one probe is/are each extendable and retractable and hidden from view when retracted;

a display unit for displaying the level of the environmental condition; and a communication unit that transmits information if the level of the environmental condition passes a predetermined threshold level, wherein the communication unit operates as a mobile phone to send an automated text message notification, an automated phone call message notification and/or an email notification to one or more recipients.

2. The device of claim 1, wherein the environmental condition is selected from the group consisting of temperature, moisture in the air, and water on the floor.

3. The device of claim 1, wherein the device further comprises a control unit for programming the threshold level of the environmental condition.

4. The device of claim 1, wherein the at least one extendable probe is/are pulled close to the floor to detect the presence of water.

5. The device of claim 1 wherein multiple probes are connected to the device, wherein one such probe is placed inside a refrigerator or freezer to monitor the temperature inside the refrigerator or freezer.

6. The device of claim 1, wherein the automated phone call is to the emergency services, the fire department, the insurance company, or any other specified phone number.

7. The device of claim 1, wherein the device further comprises an LCD display for displaying the temperature.

8. The device of claim 1, wherein the device further comprises a power outlet in the front of the device so that other utilities can occupy the power outlet at the same time.

9. The device of claim 1, wherein the device further comprises sending a notification when backup battery life is low.

10. The device of claim 1, wherein the device connects to a wireless programmable thermostat, allowing the user to monitor and adjust the thermostat remotely using a mobile application.

11. The device of claim 1, further comprising a microphone and a recording device to record a message.

12. The device of claim 1, further comprising a set of pre-recorded messages.

13. The device of claim 1, wherein the device is in electronic communication with a smoke detector, wherein the device issues a notification through the communication device if smoke is detected.

* * * * *